US007600980B2

(12) United States Patent
Sato

(10) Patent No.: US 7,600,980 B2
(45) Date of Patent: Oct. 13, 2009

(54) COOLING FAN

(75) Inventor: Yoji Sato, Seto (JP)

(73) Assignee: Aisin Kako Kabushiki Kaisha, Toyota-shi (JP)

( * ) Notice: Subject to any disclaimer, the term of this patent is extended or adjusted under 35 U.S.C. 154(b) by 549 days.

(21) Appl. No.: 11/131,409

(22) Filed: May 18, 2005

(65) Prior Publication Data

US 2005/0260077 A1 Nov. 24, 2005

(30) Foreign Application Priority Data

May 19, 2004 (JP) ..... 2004-148729

(51) Int. Cl.
*F04D 29/38* (2006.01)

(52) U.S. Cl. ..... 416/238; 416/241 A

(58) Field of Classification Search ..... 416/236 R, 416/238, 241 A

See application file for complete search history.

(56) References Cited

U.S. PATENT DOCUMENTS 4,046,488 A * 9/1977 Wickham ..... 416/210 R
4,142,844 A * 3/1979 Brattstrom ..... 417/423.15
4,569,631 A * 2/1986 Gray, III ..... 416/189
4,596,631 A * 6/1986 Prough et al. ..... 162/52
4,684,324 A * 8/1987 Perosino ..... 416/189
5,393,199 A * 2/1995 Alizadeh ..... 416/189

FOREIGN PATENT DOCUMENTS

JP 3-89000 4/1991

* cited by examiner

*Primary Examiner*—Ninh H Nguyen
(74) *Attorney, Agent, or Firm*—Westerman, Hattori, Daniels & Adrian, LLP.

(57) ABSTRACT

A cooling fan has a metal spacer, a boss made of Nylon integrally formed with the spacer by an insert molding and seven blades extending outward therefrom. A skew angle of about 30 degrees is provided at a connecting portion or a base end portion of the blade to the boss so as to be inclined backward in relation to a rotating direction of the cooling fan. To the contrary, a skew angle of about 8 degrees is provided at a portion extending from the connecting portion to the leading end of the blade so as to be inclined forward in relation to the rotating direction.

6 Claims, 4 Drawing Sheets

COOLING FAN

BACKGROUND ART

1. Field of the Invention

The present invention relates to a cooling fan used for consumer electronics or professional-use electrics or the like and improving cooling capacity and reducing size and weight.

2. Description of the Related Art

It has been conventionally required for a cooling fan used for consumer electronics or professional-use electronics or the like to improve cooling capacity and reduce size and weight. Taking a cooling fan for an automobile as an example, it is required to improve the cooling capacity by making an engine displacement large and to reduce the size and the weight from the viewpoint of scaling down a mounting space and getting a fuel consumption better. In case of improving the cooling capacity of the cooling for the automobile, an engine is disposed at the back of the cooling fan so as to disturb an airflow. Therefore, it is necessary to get an air in a diagonal flow direction in order to effectively circulate the air. However, it is required to increase a mounting angle of a blade or a vane in relation to a boss in order to obtain such a diagonal flow direction effect in a conventional axial fan. As a result, there is a problem that a rotational torque gets larger so as to lower a fan efficiency.

In an invention disclosed in a first Japanese Laid Open Patent Publication No. 3-89000, a blade has a skew angle that is set back to a leading end of the blade in relation to a fan rotating direction so as to get the air flow in the diagonal flow direction without enlarging the mounting angle of the blade, thereby improving the cooling capacity.

However, as a feature of an airflow in the automobile cooling fan, it is impossible that an air flow goes completely in an axial direction toward an engine block in a non-drive state or when there in no head wind. Rather, the airflow becomes the diagonal flow. Thus, expected effects are not obtained as is obvious from the first Patent Publication that fails to describe specific effects. That is, if there is a low pressure loss at the front of the cooling fan as in old-time cars, it is supposed that the flow toward the engine block is strong so as to enable the diagonal flow fan to have effects, as described in the first Patent Publication. However, there is a high pressure loss thereat in modern cars, so that the flow is hard to become the axial flow due to a pressure around the cooling fan or a centrifugal component by rotation of the cooling fan. Consequently, the above disadvantage occurs. Moreover, if the flow becomes the diagonal flow in the high pressure loss state, a flow toward a shroud that surrounds the cooling fan becomes strong. It may be a cause of a noise generation.

The flow toward the engine block becomes strong in a driving state as the head wind becomes large. Still, since an air volume is large due to the head wind, there is a question about necessity of increasing the air volume by getting the flow diagonal.

BRIEF SUMMARY OF THE INVENTION

In view of the above, it is an object of the invention to provide a cooling fan in which advantageous effects by increase of an air volume and reduction in size even in a high pressure loss state while generating no unnecessary noise by making use of a part of a blade, which has not been used conventionally as a working part or which deteriorates a performance, so as to generate an airflow.

According to a first aspect of the invention, there is provided a cooling fan comprising a boss of substantially a cylindrical shape; and a plurality of blades extending outward from the boss. Each of the blade having a first portion provided at a base end portion and a second portion provided at a middle to a leading end of the blade. The first portion is provided with a backward skew angle in relation to a rotating direction. The second portion has a forward skew angle not less than zero degree in relation to the rotating direction.

A cooling fan may further comprises a spacer made of a metal into a ring shape. The spacer has a deep-drawn outer circumference. The boss is made of a plastic into substantially a cylindrical shape and insert-molded integrally with the spacer.

In a cooling fan, the backward skew angle of the first portion of the blade may be provided in a range of about 10% to about 40% of a full length of the blade from a base end of the blade.

In a cooling fan, the backward skew angle of the first portion of the blade may be provided in a range of about 15 degrees to about 35 degrees.

In a cooling fan, the forward skew angle of the second portion of the blade may be provided in a range of about 0 degrees to about 20 degrees.

A cooling fan may further comprise one or more ribs provided at the base end portion of the blade so as to extend in a radial direction.

Further objects and advantages of the invention will be apparent from the following description, reference being had to the accompanying drawings, wherein preferred embodiments of the invention are clearly shown.

DETAILED DESCRIPTION OF THE INVENTION

Figure 1:
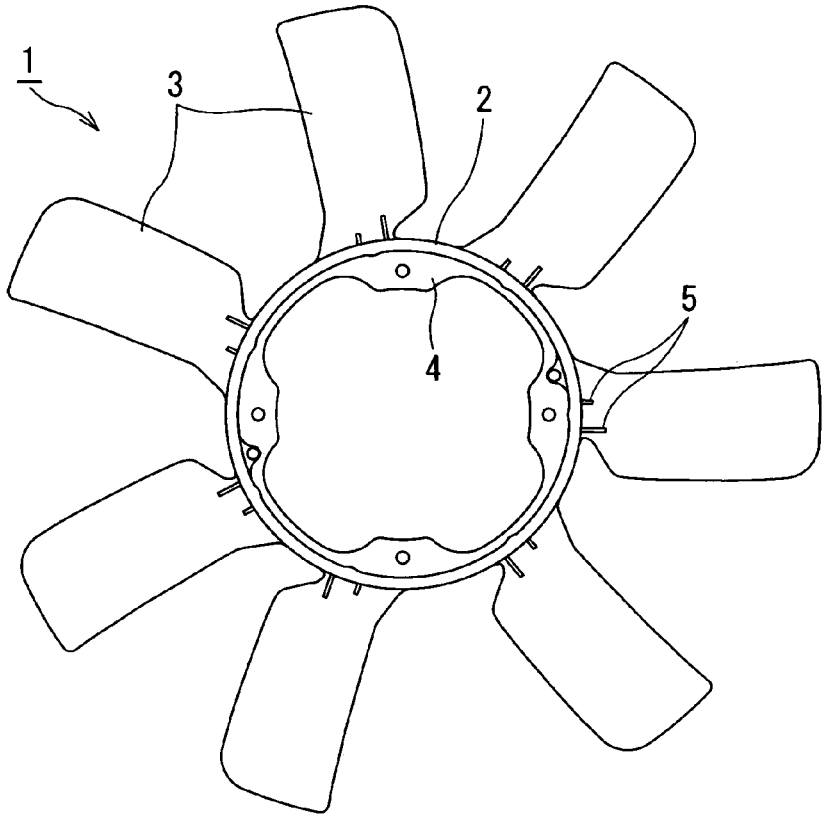
FIG. 1 is a plan view showing an entire structure of a cooling fan according to a first embodiment of the invention.
Figure 2:
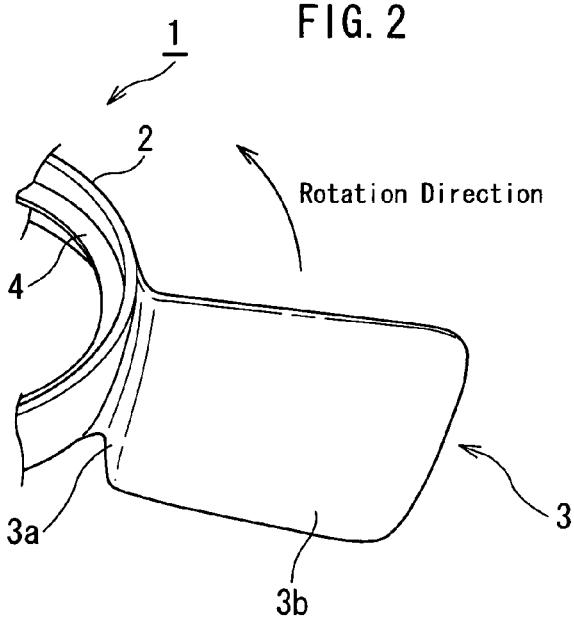
FIG. 2 is a partially enlarged view showing a negative pressure side of a blade of the cooling fan according to the embodiment of the invention.
Figure 3:
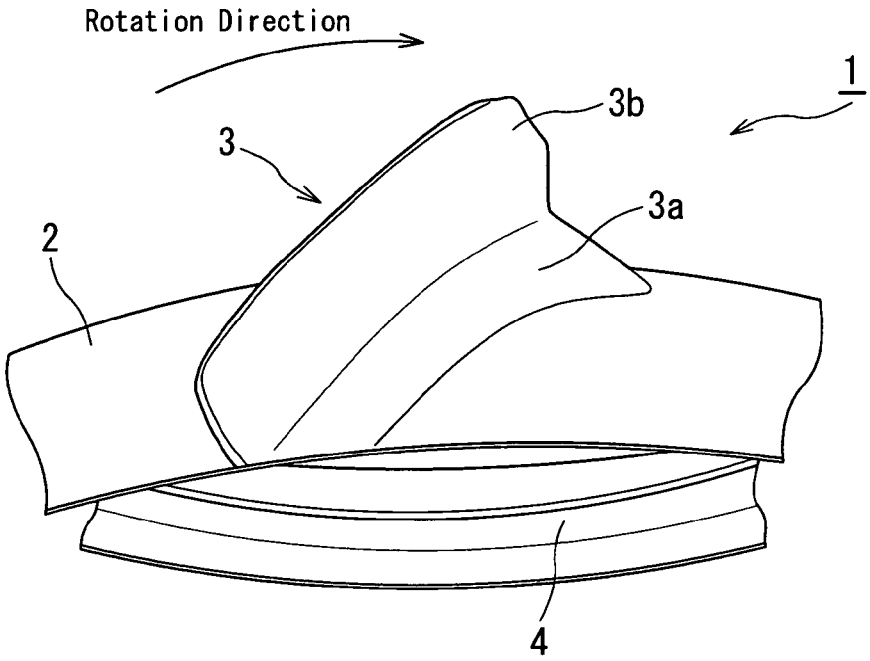
FIG. 3 is a partially enlarged view showing a positive pressure side of the blade of the cooling fan according to the embodiment of the invention.
Figure 4:
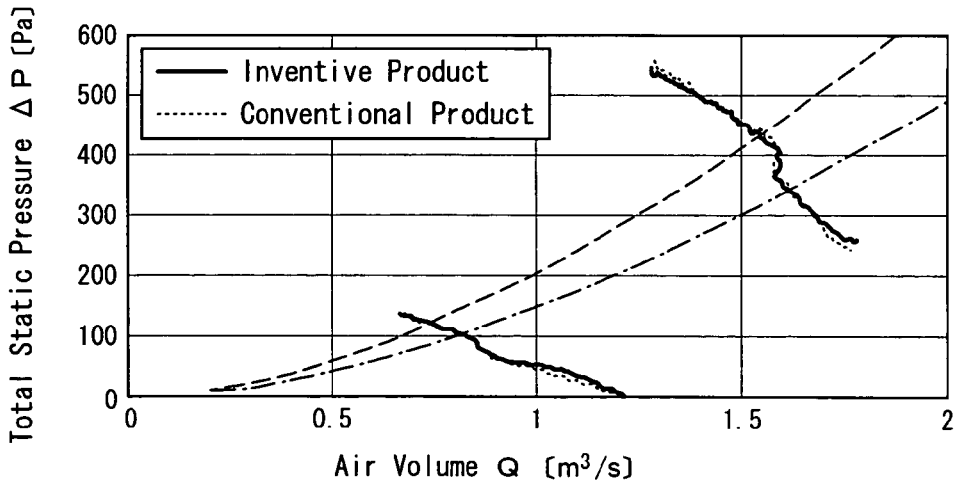
FIG. 4 is a graph showing an air volume characteristic of the cooling fan according to the embodiment of the invention and a conventional product as a comparative example.
Figure 5:
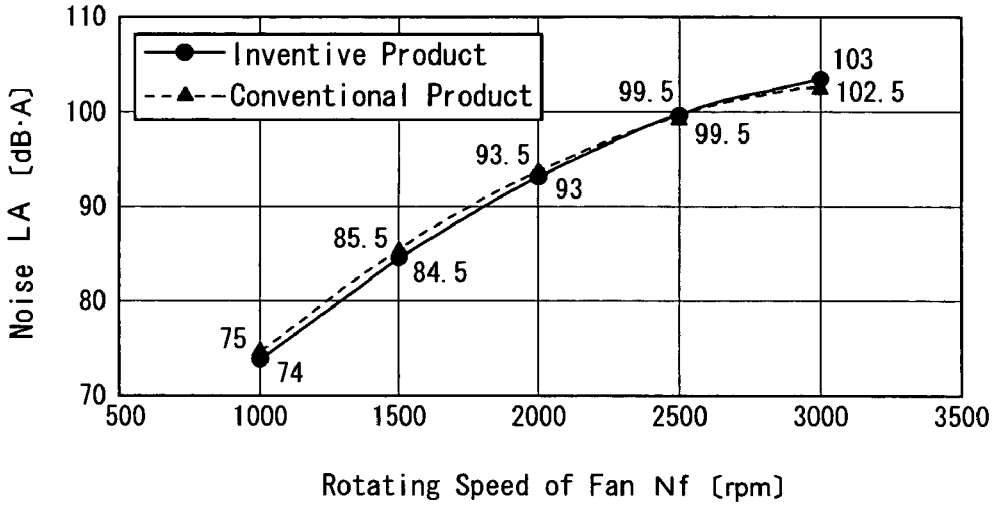
FIG. 5 is a graph showing a noise characteristic of the cooling fan according to the embodiment of the invention and a conventional product as a comparative example.

An embodiment of the invention is described hereafter referring to FIG. 1 to FIG. 5. FIG. 1 is a plan view showing an entire structure of a cooling fan according to a first embodiment of the invention. FIG. 2 is a partially enlarged view showing a negative pressure side of a blade of the cooling fan according to the embodiment of the invention. FIG. 3 is a partially enlarged view showing a positive pressure side of the blade of the cooling fan according to the embodiment of the invention. FIG. 4 is a graph showing an air volume characteristic of the cooling fan according to the embodiment of the invention and a conventional product as a comparative example. FIG. 5 is a graph showing a noise characteristic of the cooling fan according to the embodiment of the invention and a conventional product as a comparative example.

As shown in FIG. 1, the present embodiment of a cooling fan 1 has a boss 2, seven blades 3 and a spacer 4. The spacer 4 is made of a metal into a ring shape. The spacer 4 has four attachment holes. The boss 2 is made of a plastic into a cylindrical shape by an insert molding integrally with the spacer 4. Nylon is used as the plastic in the present embodiment. Two ribs 5 of different lengths are provided at a base end portion of each of the blades 3. The ribs 2 extend from an outer circumference or periphery of the boss 2. The rib 5 at a rear side in the rotating direction is formed longer than the rib 5 at a front side in the rotating direction. FIG. 1 depicts a front side of the cooling fan as a blade front edge side from which the air gets in.

Next, a connecting structure of the blades 3 to the outer circumference of the boss 2 is described referring to FIG. 2 and FIG. 3. As shown in FIG. 2, when seen from a negative pressure side, a skew angle of about 30 degrees is provided at a connecting portion 3*a* of the blade 3 to the boss 2 or at its base end portion so as to be inclined backward in relation to a rotating direction of the cooling fan 1. In contrast, a skew angle of about 8 degrees is provided at a portion 3*b* extending from the connecting portion 3*a* to a leading end of the blade 3 so as to be inclined forward in relation to the rotating direction. FIG. 3 illustrates the cooling fan seen from a positive pressure side. Also as shown in FIG. 3, the skew angle of about 30 degrees is provided at the connecting portion 3*a* of the blade 3 to the boss 2 or at the base end portion so as to be inclined backward in relation to the rotating direction of the cooling fan 1. In contrast, the skew angle of about 8 degrees is provided at the portion 3*b* extending from the connecting portion 3*a* to the leading end of the blade 3 so as to be inclined forward in relation to the rotating direction. The connecting portion 3*a* where the backward skew angle is provided has a length of about 13% to a full length of the blade 3.

An air volume characteristic test and a noise characteristic test were carried out on the cooling fan 1 according to the present embodiment having the above structure, while compared with a conventional cooling fan having essentially the same structure. The conventional cooling fan has a spacer, seven blades and a boss, too. The spacer is made of a metal into a ring shape. The blades are made of Nylon and formed integrally on the spacer by the insert molding. The boss has a cylindrical shape with an outer circumference on which the blades are connected. The conventional cooling fan has an outer diameter of 490 mm. The boss has a diameter of 192 mm. The blade has a length of 149 mm. In contrast, the cooling fan 1 according to the present embodiment has an outer diameter of 490 mm that is the same as that of the conventional one. The boss 2 has a diameter of 212 mm. The blade has a length of 139 mm.

As a measurement condition for the air volume characteristic test, a statically determinate vessel was used as a measuring device. Then, a measurement was carried out in accordance with a measuring method of "JIS B 8330-81" at two levels of rotating speed of the fan: 1000 rpm and 2000 rpm. As a measurement condition for the noise characteristic test, a sound pressure level was measured by a noise meter at a position one meter in front of the fan, while varying the rotating speed of the fan from 1000 rpm to 3000 rpm in increments of 500 rpm.

a pressure line graph or the air volume characteristic as a result of the measuring test is shown in FIG. 4. The cooling fan 1 according to the present embodiment shows an equivalent air volume characteristic as that of the conventional product in each of the two levels of the rotating speed of the fan at 1000 rpm and 2000 rpm, though the length of the blade 3 is much shorter or 10 mm shorter than that of the conventional product. With respect to the noise characteristic, the noise is lower than equivalent as compared with that of the conventional product. Thus, it was confirmed that the cooling fan 1 has a low noise effect. In these comparative tests, the diameter of the boss 1 was made larger while the outer diameter of the cooling fan 1 being the same. In case the boss 1 has the same diameter, it is supposed that an air volume more than equivalent is obtained even if the diameter, i.e. the length of the blade is made smaller or a width of the blade is made smaller.

Thus, in the present embodiment of the cooling fan 1, an airflow is generated by the connecting portion 3*a* of the blade 3 corresponding to a portion that has not been used as a working part in the conventional product. Consequently, advantageous effects are expected on increase of the air volume and reduction in size and weight, even under a high pressure loss state. Moreover, there is generated no excess noise.

As described above, the inventive cooling fan according to the present invention has the boss 1 of essentially the cylindrical shape and the plural blades 3 extending outward from the boss 1. The base end portion 3*a* of the blade 3 has the skew angle inclined backward in relation to the rotating direction, while the portion 3*b* from a middle to the leading end of the blade 3 having the skew angle of zero or inclined forward in relation to the rotating angle.

Figure 6:
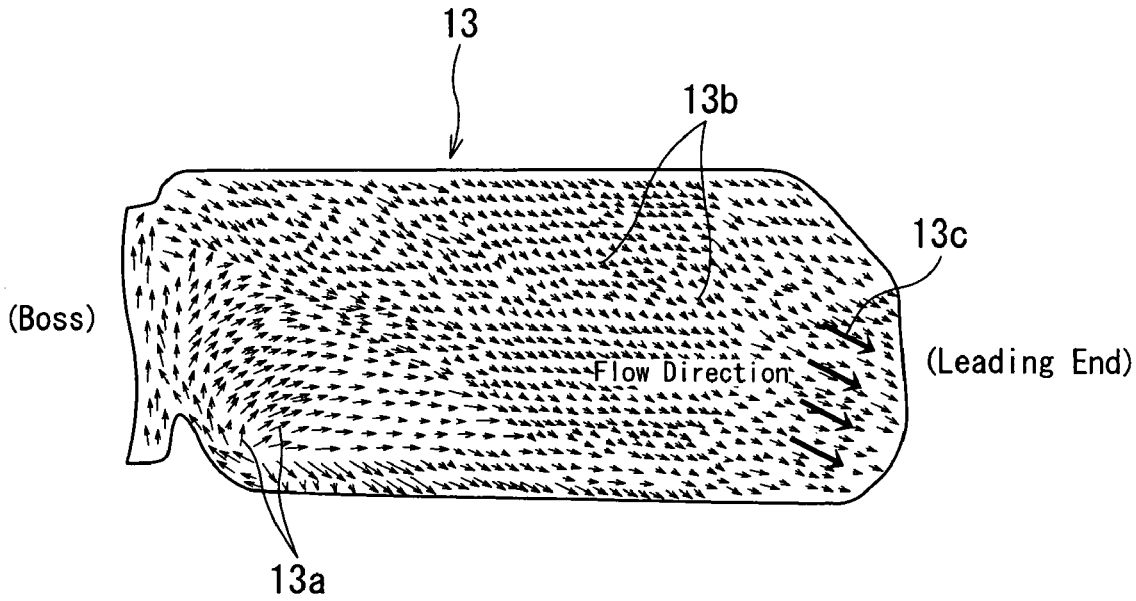
FIG. 6 is a drawing showing a measured airflow of a negative pressure side or an intake side of a blade of the conventional cooling fan.
Figure 7:
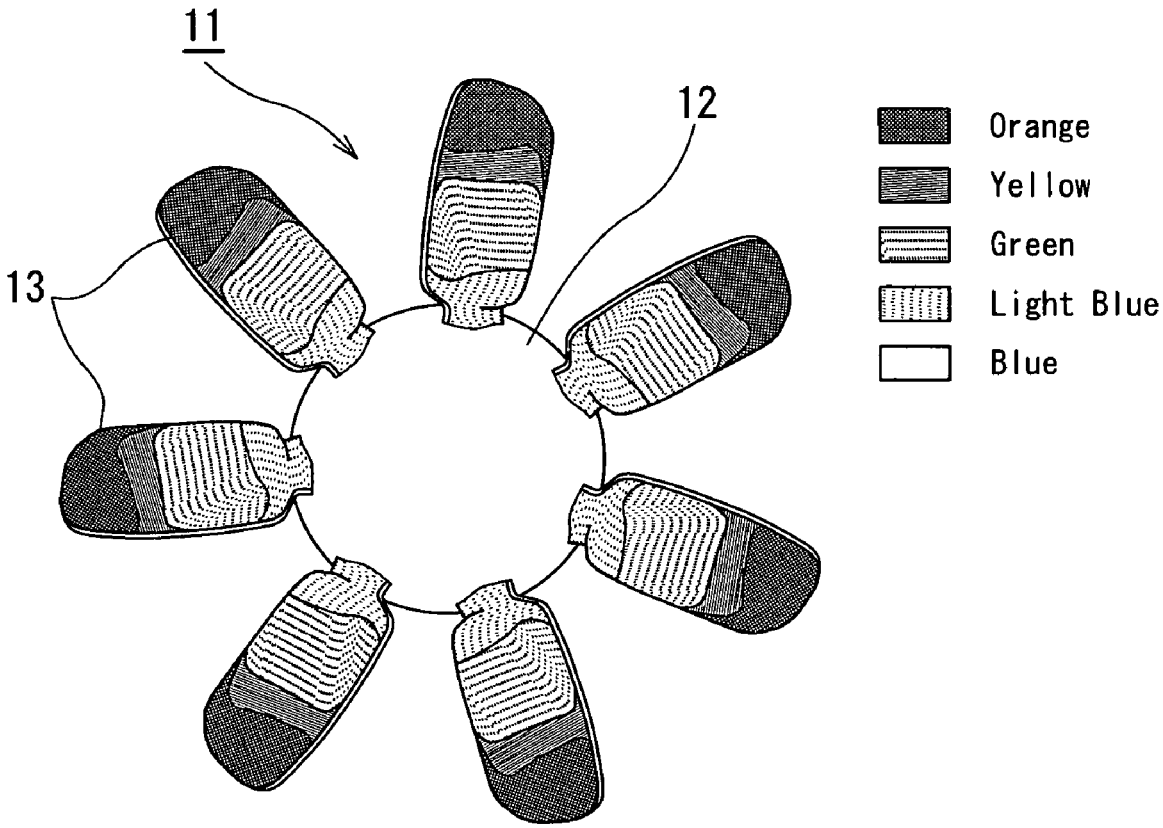
FIG. 7 is a drawing showing a measured pressure distribution of a positive pressure side or an blowout side of the blade of the conventional cooling fan.

The effects of the inventive cooling fan 1 are described in comparison with characteristics of the conventional cooling fan shown in FIG. 6 and FIG. 7. FIG. 6 is a drawing showing a measured airflow of a negative pressure side or an intake side of a blade of the conventional cooling fan. FIG. 7 is a drawing showing a measured pressure distribution of a positive pressure side or an blowout side of the blade of the conventional cooling fan.

FIG. 6 shows an airflow at a negative pressure side of a conventional blade 13 that is not provided with any skew angle at a base end portion. It is desirable to essentially generate an airflow getting over an upper side and heading toward a lower leading end of the blade 13 as shown by small arrows 13*b* that depict an airflow at the leading end side. However, an airflow heading upward swirls around at the base end portion of the blade 13 as shown by small arrows 13*a*, thereby becoming an undesirable airflow that disturbs an airflow direction shown by four large arrows 13*c*.

On the other hand, in FIG. 7, if a color comes near a red color or orange color, such part has a higher pressure. If a color comes near a blue color, such part has a lower pressure. However, in the conventional cooling fan 11, a leading end part of the blade 13 is shown by the orange color and has the highest pressure. If a part comes near a base end, the color changes from yellow, green and light blue and the pressure becomes lower accordingly. The color is blue at a boss 12 and its pressure is substantially equal to an atmosphere pressure.

As described above, in the conventional cooling fan 11, the base end part scarcely serves to generate an airflow and rather disturbs the desirable airflow at the negative pressure side. In contrast, in the inventive cooling fan 1, the skew angle is provided so as to be inclined backward in the rotating direction. Thus, when the cooling fan 1 is rotated, an air is forced to flow at the base end portion 3*a* of the blade 3 in a centrifugal and backward direction. Thereby, the base end portion 3*a* of the blade 3 serves to generate wind at the positive pressure side of the cooling fan 1. Moreover, a desirable airflow is also generated at the negative pressure side. Consequently, the air volume generated by the rotation of the cooling fan 1 increases. In addition, the cooling fan 1 can obtain the air volume more than equivalent to the conventional cooling fan 11 even if the length of blade is shortened for reduction in size. Thus, it is possible to reduce the size and the weight.

A spacer of the inventive cooling fan 1 may have an outer circumference that is formed by deep-drawing a metal ring shaped material. In this case, the boss 2 is formed integrally with such spacer into substantially the cylindrical shape by insert-molding a plastic.

Moreover, in the inventive cooling fan 1, the backward skew angle of the base end portion of the blade 3 is preferably provided from the base end of the blade 3 in the range of about 10% to about 40% of a full length of the blade 3. The skew angle is provided in such range because the airflow on the blade 3 is affected in an undesirable direction by a lower pressure around the boss 2 if the skew angle is in such range, as described in FIG. 6 and FIG. 7.

Furthermore, in the inventive cooling fan 1, the skew angle is preferably provided at the base end portion of the blade 3 so as to be inclined backward in the rotating direction in the range of about 15 degrees to about 35 degrees. If the skew angle is less than about 15 degrees, the backward skew angle is too small to achieve an effect of increasing the air volume. On the other hand, if the skew angle is more than about 35 degrees, it is hard to generate the forced airflow by the rotation unless an area where the skew angle is provided is made large. Accordingly, if the skew angle going backward in the rotating direction is provided in the range of about 15 degrees to about 35 degrees, it is possible to generate the forced airflow by the rotation by forming the backward skew angle from the base end of the blade 3 up to a suitable area. Thus, the effect by the increase of the air volume is surely obtained.

In the inventive cooling fan 1, the skew angle is preferably provided at the leading end side of the blade 3 so as to be inclined forward in the rotating direction in the range of about 0 degrees to about 20 degrees. That is, the skew angle may be zero at the leading end side of the blade 3. Alternately, if the skew angle is provided in the forward direction, the skew angle is preferably not more than about 20 degrees. As a result of a keen experiment and study, the inventor found that the largest effect of the air volume increase could be obtained in case of the forward skew angle in the range of 0 degree to about degrees. The inventor has completed the present invention on the basis of such knowledge.

In the inventive cooling fan, the two ribs 5 are provided at the base end portion of each of the blades 3 so as to extend in the radial direction. One or more ribs may be provided in the inventive cooling fan. In order to reinforce the connecting portion 3*a* between the blade 3 and the boss 2 or the base end portion of the blade 3, a curve or bulged portion is normally provided from the base end portion of the blade to the boss in the conventional art. However, since the inventive cooling fan 1 has the backward skew angle at the base end portion of the blade 3, the base end portion of the blade will be too thick if such curve is formed. This acts counter to the request of light weight. Therefore, one or more of the radially extending ribs 5 are provided at the base end portion 3*a* of each of the blades 3 in place of the curve or bulged portion, thereby enabling the base end portion 3*a* of the blade 3 to be reinforced without hardly increasing the weight of the cooling fan 1.

In the above embodiment, the cooling fan 1 is composed of the metal ring spacer 4, the plastic seven blades 3 integrally formed with the spacer 4 by the insert molding and the cylindrical boss 2 with the outer circumference to which the blades 3 are joined. However, the invention is applicable to other types of cooling fans than the above type of the cooling fan such as a cooling fan having a synthetic resin part and a metal spacer that are caulked by a bush or a cooling fan entirely made of a metal like an iron or a magnesium.

In the present embodiment, Nylon is used as the plastic of the boss 2 and the blades 3. However, the plastic is not limited thereto. Other plastics can be used including a polypropylene that is commonly used for a synthetic resin fan. Moreover, the plastic is not limited to a thermoplastic resin but means a wide scope of the plastic including a thermosetting resin.

While the blades or vanes 3 are provided in seven in the present embodiment, the number of the blades 3 are not limited to such number.

Other structure, shape, number, material, dimension, connecting relationship or the like of other parts are not limited to those of the present embodiment, either.

The preferred embodiments described herein are illustrative and not restrictive, the scope of the invention being indicated in the appended claims and all variations which come within the meaning of the claims are intended to be embraced therein.

The invention claimed is:

1. A cooling fan comprising:

a boss of substantially a cylindrical shape; and a plurality of blades extending outward from the boss;

each of the blade having a first portion provided at a base end portion and a second portion provided at a middle to a leading end of the blade, the first portion being provided with a backward skew angle in relation to a rotating direction, and the second portion having a forward skew angle not less than zero degree in relation to the rotating direction;

wherein the backward skew angle of the first portion of the blade is essentially constant over a full length of the first portion, wherein the blade includes a substantially angled corner between the first portion and the second portion.

2. A cooling fan according to claim 1, further comprising a spacer made of a metal into a ring shape, the spacer having a deep-drawn outer circumference, the boss being made of a plastic into substantially a cylindrical shape and insert-molded integrally with the spacer.

3. A cooling fan according to claim 1, in which the backward skew angle of the first portion of the blade is provided in a range of about 10% to about 40% of a full length of the blade from a base end of the blade.

4. A cooling fan according to claim 1, in which the backward skew angle of the first portion of the blade is provided in a range of about 15 degrees to about 35 degrees.

5. A cooling fan according to claim 1, in which the forward skew angle of the second portion of the blade is provided in a range of about 0 degrees to about 20 degrees.

6. A cooling fan according to claim 1, further comprising one or more ribs provided at the base end portion of the blade so as to extend in a radial direction.

* * * * *